US011359312B2

(12) United States Patent
Jones et al.

(10) Patent No.: US 11,359,312 B2
(45) **Date of Patent: *Jun. 14, 2022**

(54) WOVEN FABRIC WITH COMPARABLE TENSILE STRENGTH IN WARP AND WEFT DIRECTIONS

(71) Applicant: Nicolon Corporation, Pendergrass, GA (US)

(72) Inventors: David Michael Jones, Buford, GA (US); Kevin Nelson King, Demorest, GA (US); Larry Ray Benfield, Demorest, GA (US)

(73) Assignee: NICOLON CORPORATION, Pendergrass, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/022,422

(22) Filed: Sep. 16, 2020

(65) Prior Publication Data

US 2020/0407890 A1 Dec. 31, 2020

Related U.S. Application Data

(63) Continuation-in-part of application No. 16/091,297, filed as application No. PCT/US2017/026511 on Apr. 7, 2017, now Pat. No. 10,829,873.

(Continued)

(51) Int. Cl.

| | |
|---|---|
| ***D03D 15/00*** | (2021.01) |
| ***D03D 1/00*** | (2006.01) |
| ***D03D 13/00*** | (2006.01) |

(52) U.S. Cl.

CPC ..... *D03D 13/004* (2013.01); *D03D 1/00* (2013.01); *D03D 15/00* (2013.01);

(Continued)

(58) Field of Classification Search

CPC ..... D10B 2505/204; D10B 2321/022; D10B 2321/021; D10B 2331/04; D10B 2331/02;

(Continued)

(56) References Cited

U.S. PATENT DOCUMENTS 3,395,198 A * 7/1968 Yasumura ..... C08L 39/04 525/217
5,108,224 A * 4/1992 Cabaniss ..... D03D 15/00 139/426 R (Continued)

FOREIGN PATENT DOCUMENTS

| | | |
|---|---|---|
| CL | 201101803 | 7/2011 |
| CL | 201202293 | 8/2012 |
| CN | 105378167 A | 3/2016 |

OTHER PUBLICATIONS

Behera et al., "Woven Textile Structure", Theory and applications, Woodhead Publishing Series in Textile, The Textile Institute, 2010, pp. 142-146.

(Continued)

*Primary Examiner* — Robert H Muromoto, Jr.
(74) *Attorney, Agent, or Firm* — Cantor Colburn LLP

(57) ABSTRACT

A woven geosynthetic fabric having a weft direction and a warp direction, includes weft yarns woven in the weft direction and warp yarns woven in the warp direction interweaving the weft yarns to form a fabric having comparable modulus; the warp yarns including a high modulus monofilament yarn having a tenacity of at least 0.75 g/denier at 1% strain, at least 1.5 g/denier at 2% strain, and at least 3.75 g/denier at 5% strain as determined in accordance with ASTM International Standard 4595.

24 Claims, 1 Drawing Sheet

Related U.S. Application Data

(60) Provisional application No. 62/319,481, filed on Apr. 7, 2016.

(52) U.S. Cl.
CPC .... *D10B 2321/022* (2013.01); *D10B 2331/02* (2013.01); *D10B 2331/04* (2013.01); *D10B 2401/10* (2013.01); *D10B 2505/204* (2013.01)

(58) Field of Classification Search
CPC ..... D10B 2401/041; D10B 2401/063; D10B 2321/02; D10B 2401/22; D10B 2505/18; D10B 2401/10; D03D 15/0088; D03D 15/00; D03D 11/00; D03D 1/00; D03D 15/0027; D03D 15/04; D03D 13/004; D03D 15/0094; D03D 13/00; D03D 15/0083; D03D 25/00; D03D 25/005; D03D 15/44; D03D 15/46
See application file for complete search history.

(56) References Cited

U.S. PATENT DOCUMENTS 5,468,259 A * 11/1995 Sheth ..... C08G 81/021 8/497
5,655,585 A * 8/1997 Fry ..... E06B 9/13 160/10
5,769,131 A * 6/1998 Whitlock ..... D03D 15/00 139/383 AA
5,927,222 A * 7/1999 Eakin ..... B63C 1/02 114/45
6,418,974 B1 * 7/2002 King ..... B01D 46/0001 139/383 R
6,769,535 B2 * 8/2004 Zilker ..... D21F 1/0045 198/847
7,132,376 B2 * 11/2006 Rashed ..... B32B 5/26 442/2
7,465,129 B2 * 12/2008 Singleton ..... E02D 17/20 256/12.5
8,333,220 B2 * 12/2012 King ..... D03D 11/00 139/383 A
8,598,054 B2 * 12/2013 King ..... D03D 15/0027 442/207
9,777,455 B2 * 10/2017 Sutton ..... E02D 17/202
10,024,022 B2 * 7/2018 Booth ..... E02D 17/202
10,434,445 B2 * 10/2019 Ray ..... D03D 13/008
10,487,471 B2 * 11/2019 Booth ..... D03D 15/00
10,508,400 B2 * 12/2019 Booth ..... A01G 13/00
2004/0171318 A1 * 9/2004 Rashed ..... B32B 5/26 442/33
2006/0240733 A1 * 10/2006 Bieser ..... D01F 6/46 442/414
2007/0173162 A1 * 7/2007 Ethiopia ..... C08L 23/10 442/327
2007/0277897 A1 * 12/2007 King ..... D03D 11/00 139/420 R
2011/0250809 A1 * 10/2011 King ..... D03D 15/0088 442/185
2014/0241817 A1 * 8/2014 Jones ..... D03D 9/00 405/302.7
2015/0159305 A1 * 6/2015 Booth ..... D03D 15/0088 442/189
2019/0145028 A1 5/2019 Jones et al.
2019/0366678 A1 * 12/2019 Jones ..... D03D 15/00

OTHER PUBLICATIONS

Hu, Jinlian; Structure and mechanics of woven fabrics, Chapter 4, Woodhead Publishing in Textiles, pp. 91-92, 2004.
International Search Report and Written Opinion received in International Patent Application No. PCT/US2017/026511, filed Apr. 7, 2017, Applicant: Nicolon Corporation d/b/a TenCate Geosynthetics of North America, dated Jul. 6, 2017, pp. 1-12.

* cited by examiner

WOVEN FABRIC WITH COMPARABLE TENSILE STRENGTH IN WARP AND WEFT DIRECTIONS

CROSS-REFERENCE TO RELATED APPLICATIONS

This present application is a Continuation-in-Part of U.S. patent application Ser. No. 16/091,297, filed Oct. 4, 2018, which is a US national stage entry of PCT Application Serial No. PCT/US2017/026511, filed Apr. 7, 2017, which claims benefit of U.S. Provisional Patent Application Ser. No. 62/319,481 filed Apr. 7, 2016, all applications are incorporated herein in their entirety by reference.

BACKGROUND

In traditional weaving of a material, crimp is introduced into the yarns woven in the machine direction (i.e., warp yarns). As a result of the warp yarn interlacing with the weft yarns, the warp yarn contains inherent crimp. This warp crimp causes a significant reduction in the tensile strength at low strain rates in the machine direction (MD) when compared to the tensile strength in the cross-machine direction (CD).

During a tensile test, there are two main contributors to tensile strength (modulus): 1) warp crimp and 2) tensile strength of the yarn. In the initial portion of the stress/strain curve, at low strain values (e.g., 1%-5% strain), the warp crimp in the material is removed. This crimp removal typically requires very small tensile loads resulting in lower tensile values at these lower strains (i.e., 1%-5% strain). It is therefore desirable to minimize warp crimp as much as possible in order to maximize the MD tensile strength in the fabric. Many geosynthetic applications have a clause written in that describe the product in its weakest principle direction. However, in many applications the stresses and strains of the application cannot be dictated or predicted as to which direction will receive more of the principle load. In addition, seaming geotextile panels will naturally cause weaker tensile properties at respective joints.

Accordingly, there is a need for a modulus balanced, woven geosynthetic fabric in which the effect of warp crimp is minimized while maintaining other properties desirable for civil applications, such as relatively high water flow rates and particle retention.

BRIEF DESCRIPTION

Disclosed herein is a woven geosynthetic fabric having a weft direction and a warp direction. The weft yarns are woven in the weft direction and the warp yarns woven in the warp direction interweave the weft yarns to form a fabric. In one aspect, the fabric has a tensile strength of at least 100 pounds/inch (lb/in) at 2% strain in both the warp and weft directions as respectively measured in accordance with ASTM International Standard D4595. In another aspect, the fabric has a tensile strength of at least 200 lb/in at 5% strain in both the warp and weft directions as respectively measured in accordance with ASTM International Standard ASTM International Standard D4595. Yet, in another aspect, the fabric has a repeating pattern of a first shed comprising one or more yarns having a total denier between about 200 denier to about 1000 denier and a second shed comprising one or more yarns having a total denier between about 400 denier to about 15,000 denier, the total denier of the second shed is at least 50% greater than the total denier of the first shed, and the first shed is adjacent the second shed. Still, in another aspect, the fabric has a repeating pattern of at least one yarn disposed in a first shed and at least two yarns disposed in a second shed with the first shed being adjacent the second shed, and the fabric has a tensile strength in the warp direction in a range of about 80% to about 120% of the tensile strength in the weft direction as respectively measured in accordance with ASTM International Standard D4595 at 5% strain. As disclosed herein, the fabric can have an apparent opening size (AOS) of at least 30 as measured in accordance with ASTM International Standard D475. Further, the fabric can have a water flow rate of at least 75 gpm/ft$^2$ as measured in accordance with ASTM International Standard D449.

The above described and other features are exemplified by the following figures and detailed description.

BRIEF DESCRIPTION OF THE DRAWINGS

The following figures are exemplary embodiments wherein the like elements are numbered alike.

DETAILED DESCRIPTION

Figure 1:
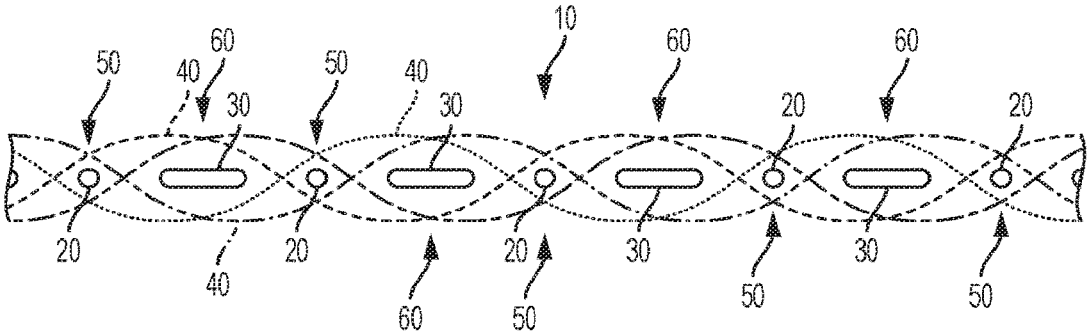
FIG. 1 is a cross-sectional view of an embodiment of a woven geosynthetic fabric.

Disclosed herein are geosynthetic fabrics having comparable modulus tensile properties. That is, the woven fabric has comparable tensile strength values in both the warp (machine) direction and the weft (cross machine) direction at specified elongation values that are relevant to civil engineering specifications. Tensile strength is measured in accordance with American Society for Testing and Materials International Standard (ASTM) D4595. In addition, the fabric can have an apparent opening size (AOS) of at least 30 as measured in accordance with ASTM D4751. Further, the fabric can have a waterflow of greater than 75 gallons per minute square feet (gpm/ft$^2$) as measured in accordance with ASTM D4491.

For example, the woven geosynthetic fabric has weft yarns woven in the weft direction and warp yarns woven in the warp direction interweaving the weft yarns to form the fabric. The fabric has an AOS of at least 30 and a water flow rate of at least 75 gpm/ft$^2$. Further, the fabric has respective tensile strengths of at least 100 lb/in at 2% strain in both the warp and weft directions. In another aspect, the fabric has respective tensile strengths of at least 125 lb/in at 2% strain in both the warp and weft directions. Yet, in another aspect, the fabric has respective tensile strengths of at least 130 lb/in at 2% strain in both the warp and weft directions.

In another aspect, the woven geosynthetic fabric has weft yarns woven in the weft direction and warp yarns woven in the warp direction interweaving the weft yarns to form the fabric. The fabric has an AOS of at least 30 and a water flow rate of at least 75 gpm/ft$^2$. Further, the fabric has respective tensile strengths of at least 200 lb/in at 5% strain in both the warp and weft directions. In another aspect, the fabric has respective tensile strengths of at least 250 lb/in at 5% strain in both the warp and weft directions. Yet, in another aspect, the fabric has respective tensile strengths of at least 300 lb/in at 5% strain in both the warp and weft directions. Still, in another aspect, the fabric has respective tensile strengths of at least 350 lb/in at 5% strain in both the warp and weft directions. Yet still, in another aspect, the fabric has respective tensile strengths of at least 400 lb/in at 5% strain in both the warp and weft directions.

Yet, in another aspect, the woven geosynthetic fabric has weft yarns woven in the weft direction and warp yarns woven in the warp direction interweaving the weft yarns to form the fabric. The fabric has an AOS of at least 30 and a repeating pattern of a first shed comprising one or more yarns having a total denier between about 200 denier to about 1000 denier and a second shed comprising one or more yarns having a total denier between about 400 denier to about 15,000 denier, and the total denier of the second shed being at least 50% greater than the total denier of the first shed, the first shed being adjacent the second shed. In another aspect, the total denier of the second shed is at least 100% greater than the total denier of the first shed. Yet, in another aspect, the total denier of the second shed is at least 150% greater than the total denier of the first shed. Still, in another aspect, the total denier of the second shed is at least 200% greater than the total denier of the first shed. The term "total denier" means the sum of denier of the respective yarns disposed in a specific shed. For example, the total denier of a 1,000 denier yarn and a 1,500 denier yarn disposed in the same shed is 2,500 denier.

Still, in another aspect, the woven geosynthetic fabric has weft yarns woven in the weft direction and warp yarns woven in the warp direction interweaving the weft yarns to form the fabric. The fabric has an AOS of at least 30 and a repeating pattern of at least one yarn disposed in a first shed and at least two yarns disposed in a second shed, the first shed being adjacent the second shed. Further, the fabric has a tensile strength in the warp direction in a range of about 80% to about 120% of the tensile strength in the weft direction as respectively measured at 5% strain. In another aspect, the fabric has a tensile strength in the warp direction in a range of about 85% to about 115% of the tensile strength in the weft direction as respectively measured at 5% strain. Further, in another aspect, the fabric has a tensile strength in the warp direction in a range of about 90% to about 110% of the tensile strength in the weft direction as respectively measured at 5% strain. Yet, in another aspect, the fabric has a tensile strength in the warp direction in a range of about 95% to about 105% of the tensile strength in the weft direction as respectively measured at 5% strain.

Moreover, in another aspect, the fabric has one yarn disposed in the first shed and two yarns disposed in the second shed, the yarns of the second shed being the same or different, and the yarn of the first shed being the same as or different from the yarns of the second shed. Further, in another aspect, the fabric has one yarn disposed in the first shed and three yarns disposed in the second shed, the yarns of the second shed being the same or different, and the yarn of the first shed being the same as or different from the yarns of the second shed. Still, in another aspect, the fabric has two yarns disposed in the first shed and two yarns disposed in the second shed, the yarns of the first shed being the same or different, the yarns of the second shed being the same or different, and the yarns of the first shed being the same as or different from the yarns of the second shed. Yet still, the fabric has two yarns disposed in the first shed and three yarns disposed in the second shed, the yarns of the first shed being the same or different, the yarns of the second shed being the same or different, and the yarns of the first shed being the same as or different from the yarns of the second shed.

In some aspects, the one or more yarns in the first shed are a monofilament yarn, a fibrillated tape, or any combination thereof; the one or more yarns in the second shed are a monofilament yarn, a fibrillated tape, or any combination thereof; and the yarns respectively disposed in the first and second sheds can be the same or different. For example, the one or more yarns in the first shed can comprise a monofilament yarn and the one or more yarns in the second shed can comprise fibrillated tape. Moreover, the one or more yarns in the first shed can comprise a monofilament yarn, and the one or more yarns in the second shed can comprise a combination of monofilament yarn and fibrillated tape.

As indicated above, the geosynthetic fabric comprises a repeating pattern of two specialized fabric sheds. The first shed is a "high tensile/high modulus" shed whereby the warp yarn is floating over a large denier weft yarn, causing the warp yarn to have a low level of weaving crimp. The second shed is a "high flow/high AOS" shed, whereby the warp yarn is floating over a monofilament weft yarn, resulting in a slightly higher level of weaving crimp in the warp yarn. These two specialized sheds create a taller (thicker) shed and a smaller (thinner) shed, that is, sheds having varying warp crimp amplitude. The taller shed has a greater thickness than the smaller shed. The result is a rougher surface on the geotextile which is beneficial in civil applications where it is desired to have sufficient shear face interaction with the soil and/or aggregate material which is in intimate contact with the geotextile. The greater the shear angle between the two surfaces, the more difficult it is to push or pull the geotextile out of the in situ system. The alternating shed pattern also produces a synergy in the product that allows comparable tensile strength properties in the warp and weft directions and "hydraulic" properties (AOS, water flow, strength, etc.) to be met in a single warp woven fabric.

In some aspects, the first shed (the high tensile/high modulus shed) has a thickness of about 50 mils to about 150 mils, and the second shed (the high flow/high AOS shed) has a thickness of about 10 mils to about 70 mils. In other aspects, the first shed and the second shed differ in height (thickness) by about 10% to about 60%. In other aspects, the first shed and the second shed differ in height (thickness) by about 15% to about 55%, about 20 to about 50%, about 25% to about 45%, or about 30% to about 40%. Yet, in some aspects, the first shed and the second shed differ in height (thickness) by an amount about or in any range between about 10%, 15%, 20%, 25%, 30%, 35%, 40%, 45%, 50%, 55%, and 60%.

Figure 2:
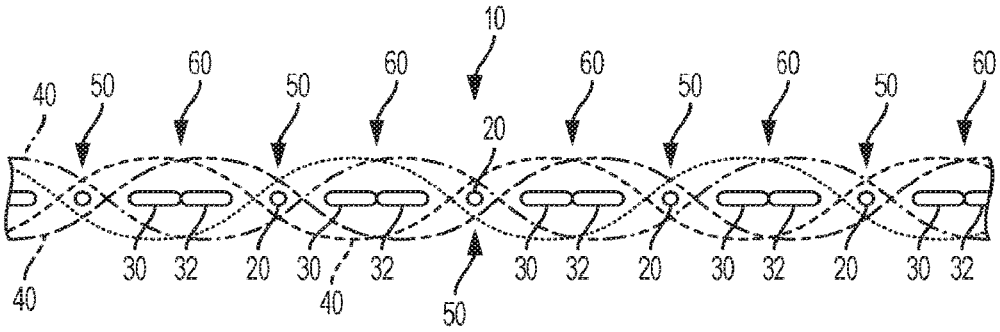
FIG. 2 is a cross-sectional view of another embodiment of the woven geosynthetic fabric.
Figure 3:
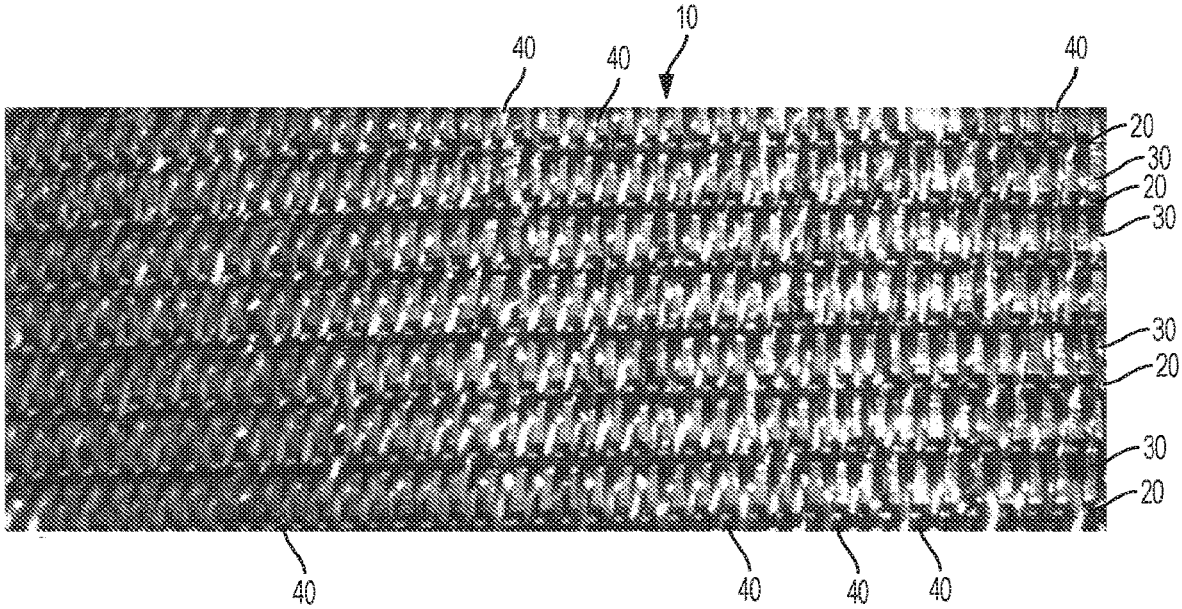
FIG. 3 is a top view of the woven geosynthetic fabric utilizing a 2/2 twill weave.

Reference is made to FIGS. 1-3, wherein like reference numerals indicate like parts throughout the figures. FIGS. 1-3 illustrate respective embodiments of a woven geosynthetic fabric 10 with comparable tensile strength in the warp and weft directions utilizing a 2/2 twill weave pattern. As illustrated in FIG. 1 and FIG. 3, the fabric 10 includes in the weft (fill) direction a first weft yarn 20, and a second weft yarn 30. The first and second weft yarns 20, 30 are interwoven with warp yarns 40. The first weft yarns 20 are in a first shed 50 and the second weft yarns are in a second shed 60 adjacent to the first shed 50. The first shed 50 and second shed 60 form a repeating pattern of alternating sheds in the fabric weave. Specifically, in FIG. 1, the fabric 10 has one monofilament in the first shed and one fibrillated tape in the second shed.

FIG. 2 illustrates the fabric having one monofilament (first yarn 20) in the first shed and two fibrillated tapes (second yarns 30 and 32) in the second shed. While second yarns 30 and 32 are illustrated as being fibrillated tape, it is not required for second yarns 30 and 32 to be the same.

In one aspect, the woven fabric 10 comprises a repeating pattern of two or more first weft yarns 20 in the first shed 50 and a second weft yarn 30 in the second shed 60. In one aspect, the woven fabric 10 comprises a repeating pattern of two first weft yarns 20 in the first shed 50 and a second weft yarn 30 in the second shed 60. In yet another aspect, the woven fabric 10 comprises three first weft yarns 20 in the first shed 50 and a second weft yarn 30 in the second shed 60.

The first and second weft yarns 20, 30 can be the same or they can be different. In one aspect, first weft yarns 20 and second weft yarns 30 are different and comprise two types of yarns of differing cross-sectional shapes. In some aspects, first weft yarn 20 is a fibrillated tape yarn having a rectilinear cross-section with a width greater than its thickness. The first weft yarns 20 comprise fibrillated tape of about 500 to about 6500 Denier. In one aspect, the first weft yarn 20 comprises a fibrillated tape of about 3000 to about 6500 Denier. In another aspect, the first weft yarns 20 comprise a fibrillated tape of about 3600 to about 6200 Denier, and in yet another aspect, the first weft yarns 20 comprise a fibrillated tape of about 4600 to about 5600 Denier. In one aspect, the first weft yarns 20 comprise a fibrillated tape of about 4600 Denier.

In various aspects, the first weft yarn 20 is a high modulus fibrillated tape yarn having a tenacity of at least 0.75 g/denier at 1% strain, at least 1.5 g/denier at 2% strain, and at least 3.75 g/denier at 5% strain. Tenacity, a referenced herein, is determined in accordance with ASTM D2256. Second weft yarn 30 is a monofilament yarn having a different geometrically shaped cross-section from that of the first weft yarn. In one aspect, the second weft yarn 30 has a substantially rounded cross-sectional shape, i.e., a substantially circular cross-sectional shape. In one aspect, the second weft yarn 30 is a monofilament yarn of about 400 to about 1600 Denier. In another aspect, the second weft yarn 30 is a monofilament yarn of about 400 to about 925 Denier, and in yet another aspect, the second weft yarn 30 is a monofilament yarn of about 425 to about 565 Denier.

Fibrillated tapes have a non-round cross-sectional shape that can be irregular bundles and packs into a shed to provide a different cross sectional shape, for example when used in combination with a round monofilament in another shed, based on the number of warp yarns, warp tension, size of warp yarn, etc. The shape of the fibrillated tape will affect the AOS and water flow of the fabric, but not modulus or tensile.

In another aspect, first weft yarn 20, the second weft yarn 30, or both, has a cross-sectional shape that is non-round. For example, the first weft yarn 20 and/or the second weft yarn 30 has a cross-sectional shape that is oval.

Yet, in another aspect, the first weft yarn 20, the second weft yarn 30, or both, has a cross-sectional shape that is multi-lobal. Non-limiting examples of multi-lobal cross-sectional shapes include multi-channel, tri-lobal, and pillow cross-sectional shapes.

The first and second weft yarns 20, 30 are woven together with a warp yarn 40. In some aspects, the warp yarns 40 comprise a high modulus monofilament yarn of about 1000 to about 1500 Denier. In one aspect, the warp yarns 40 comprise a high modulus monofilament yarn of about 1200 to about 1400 Denier. In yet another aspect, the warp yarns 40 comprise a high modulus monofilament yarn of about 1360 Denier. In various aspects, the warp yarns 40 are high modulus monofilament yarns having a tenacity of at least 0.75 g/denier at 1% strain, at least 1.5 g/denier at 2% strain, and at least 3.75 g/denier at 5% strain.

The monofilament, yarn, or tape yarns employed herein, collectively referred to herein as "yarn or yarns," include yarns comprising, in some aspects, polypropylene, yarns comprising an admixture of polypropylene and a polypropylene/ethylene copolymer, or yarns comprising an admixture of polypropylene and polyethylene, or any combination of such yarns. Warp and weft yarns can be the same or different.

As mentioned above, yarns disposed in the first or second sheds can be the same or different. For example, the yarns disposed in the first and second sheds can have different cross-sectional shapes, be formed of different polymers, and/or have different surface areas. Although, the differences between the yarns in the first and second sheds are not limited to these differences and can have different properties than those in the foregoing list. Still further, yarns disposed is a given shed can be the same or different.

In one aspect, the yarns (warp and/or weft yarns) can comprise a polypropylene composition comprising a melt blended admixture of about 94 to about 95% by weight of polypropylene and at least about 5% by weight of a polypropylene/ethylene copolymer or polymer blend. In another aspect, the yarns can comprise an admixture of about 90% by weight of polypropylene and about 10% by weight of a polypropylene/ethylene copolymer of polymer blend. Further, the polypropylene/ethylene copolymer has an ethylene content of about 5% to about 20% by weight of the copolymer. In one aspect, the polypropylene/ethylene copolymer has an ethylene content of about 16% by weight of copolymer. In another aspect, aspect the polypropylene/ethylene copolymer has an ethylene content of about 5% to about 17% by weight of copolymer. In yet another aspect, aspect the polypropylene/ethylene copolymer has an ethylene content of about 5%, about 6%, about 7%, about 8%, about 9%, about 10%, about 11%, about 12%, about 13%, about 14%, about 15%, about 16%, about 17%, about 18%, about 19%, or about 20%, or any range therebetween, by weight of copolymer. Still, in another aspect, the polypropylene/ethylene copolymer has an ethylene content of about 16% by weight of copolymer. Such an admixture is referred to herein as "high modulus" yarn. The high modulus yarn is described in U.S. patent application Ser. No. 13/085,165, to Jones et al. entitled "Polypropylene Yarn Having Increased Young's Modulus and Method of Making Same," ("Jones et al.") which is incorporated herein by reference in its entirety.

As described by Jones et al., in some aspects, the monofilament, yarn, or tape of the warp and/or weft yarns has an improved Young's modulus as compared to monofilament, yarn, tape, or staple fiber made from neat polypropylene homopolymer. Young's modulus (E), also known as the modulus of elasticity, is a measure of the stiffness of an isotropic elastic material. It is defined as the ratio of the uniaxial stress over the uniaxial strain in the range of stress in which Hooke's Law holds. This can be experimentally determined from the slope of a stress-strain curve created during tensile tests conducted on a sample of the material. See International Union of Pure and Applied Chemistry, "Modulus of Elasticity (Young's modulus), E", Compendium of Chemical Terminology, Internet edition.

In one or more aspects, the monofilament, yarn, tape, or staple fiber has a Young's modulus greater than 3.5. Young's modulus, as referenced herein, is determined in accordance with ASTM D2256. In another aspect, the monofilament, yarn, tape, or staple fiber of the present invention has a Young's modulus of at least 4 GigaPascal (GPa), at least 4.5 GPa, at least 5 GPa, at least 5.5 GPa, at least 6 GPa, at least 6.5 GPa, or at least 6.9 GPa.

Furthermore, in various aspects, the monofilament, yarn, or tape each has a tenacity of at least 0.75 g/Denier at 1% strain, at least 1.5 g/Denier at 2% strain, and at least 3.75 g/Denier at 5% strain. In another aspect such monofilament, yarn, tape, or staple fiber respectively has a tenacity of at least 0.9 g/Denier at 1% strain, at least 1.75 g/Denier at 2% strain, and at least 4 g/Denier at 5% strain. Still, in another aspect such monofilament, yarn, tape, or staple fiber respectively has a tenacity of about 1 g/Denier at 1% strain, about 1.95 g/Denier at 2% strain, and about 4.6 g/Denier at 5% strain.

In some aspects, the weft yarns and/or warp yarns are, independently, made from an acrylic acid polymer, an aramid polymer, a fluoropolymer, a high density polyetheylene, a low density polyethylene, a linear low density polyethylene, a polyacrylonitrile, a polyamide, a polybutylene terephthalate, a polycarbonate, a polyetherimide, a polyether ether ketone, a polyethylene copolymer, a polyethylene terephthalate, a polytetrafluoroethylene, a polyimide, a polylactic acid, a polyolefin, a polyphenylene, a polyphenylene oxide, a polyphenylene sulfide, a polyolefin, a polypropylene, a polypropylene/ethylene copolymer, a polystyrene, a polyurethane, an ultra-high molecular-weight polyethylene, a vinyl polymer, or any combination thereof.

In other aspects, the yarns disposed in the first and second sheds have different surface areas. In some non-limiting examples, at least one first weft yarn in the first shed and/or at least one second weft yarn in the second shed is a texturized yarn, a continuous filament yarn, a staple yarn, a spun yarn, a twisted yarn, an air tacking yarn, or any combination thereof.

A woven fabric typically has two principle directions, one being the warp direction and the other being the weft direction. The weft direction is also referred to as the fill direction. The warp direction is the length wise, or machine direction (MD) of the fabric. The fill or weft direction is the direction across the fabric, from edge to edge, or the direction traversing the width of the weaving machine (i.e., the cross machine direction, CD). Thus, the warp and fill directions are generally perpendicular to each other. The set of yarns, threads, or monofilaments running in each direction are referred to as the warp yarns and the fill yarns, respectively.

A woven fabric can be produced with varying densities. This is usually specified in terms of number of the ends per inch in each direction (i.e., the warp direction and the weft direction). The higher this value is, the more ends there are per inch and thus the fabric density is greater or higher.

The woven fabric is constructed so that the number of ends in the warp is in the range from about 20 per inch to about 55 per inch. In another aspect the number of ends in the warp is about 35 per inch to about 50 per inch. Still, in another aspect, the number of ends in the warp is about, or in the range of, 35, 36, 37, 38, 39, 40, 41, 42, 43, 44, 45, 46, 47, 48, 49, and 50 per inch. In yet another aspect, the woven fabric is constructed with 45 ends per inch.

It is desirable to keep the pick/inch value as low as possible in order to minimize warp crimp and thus increase machine direction modulus. The weft of the woven fabric typically has a number of picks in the range from about 6 per inch to about 20 per inch. In another aspect the number of picks is in the range from about 8 per inch to about 15 per inch to provide sufficient compaction to limit air flow through the fabric. In yet another aspect the fabric has about 10 to 14 picks per inch. Still, in another aspect the number of picks in the weft is about or in the range of 10, 10.5, 11, 11.5, 12, 12.5, 13, 13.5, and 14 per inch.

The term "shed" is derived from the temporary separation between upper and lower warp yarns through which the fill yarns are woven during the weaving process. The shed allows the fill yarns to interlace into the warp to create the woven fabric. By separating some of the warp yarns from the others, a shuttle can carry the fill yarns through the shed, for example, perpendicularly to the warp yarns. As known in weaving, the warp yarns which are raised and the warp yarns which are lowered respectively become the lowered warp yarns and the raised warp yarns after each pass of the shuttle. During the weaving process, the shed is raised; the shuttle carries the weft yarns through the shed; the shed is closed; and the fill yarns are pressed into place. Accordingly, as used herein with respect to the woven fabric, the term "shed" means a respective fill set which is bracketed by warp yarns.

The weave pattern of fabric construction is the pattern in which the warp yarns are interlaced with the fill yarns. A woven fabric is characterized by an interlacing of these yarns. For example, plain weave is characterized by a repeating pattern where each warp yarn is woven over one fill yarn and then woven under the next fill yarn. There are many variations of weave patterns commonly employed in the textile industry, and those of ordinary skill in the art are familiar with most of the basic patterns. While it is beyond the scope of the present application to include a disclosure of this multitude of weave patterns, the basic plain and twill weave patterns can be employed with the present invention. However, such patterns are only illustrative, and the invention is not limited to such patterns. It should be understood that those of ordinary skill in the art will readily be able to determine how a given weave pattern could be employed in practicing the present invention in light of the parameters herein disclosed.

A twill weave, relative to the plain weave, has fewer interlacings in a given area. The twill is a basic type of weave, and there are a multitude of different twill weaves. A twill weave is named by the number of fill yarns which a single warp yarn goes over and then under. For example, in a 2/2 twill weave, a single warp end weaves over two fill yarns and then under two fill yarns. In a 3/1 twill weave, a single warp end weaves over three fill yarns and then under one fill yarn. For fabrics being constructed from the same type and size of yarn, with the same thread or monofilament densities, a twill weave has fewer interlacings per area than a corresponding plain weave fabric.

In one aspect, in the woven fabric, the warp yarns interweave the weft yarns to form a weave comprising one or more of a plain weave, a 2/1 twill weave, a 2/2 twill weave, and a 3/1 twill weave. In another aspect, the warp yarns interweave the weft yarns to form a twill weave comprising a repeating pattern of two or more first weft yarns comprising a high modulus fibrillated tape yarn in the first shed and a second weft yarn comprising a monofilament yarn in the second shed. FIG. 1 is an illustration of a cross-sectional view of a 2/2 twill weave having a construction comprising a repeating pattern of fibrillated tape yarns in a first shed and a monofilament yarn in a second shed. FIG. 3 is a top view of a 2/2 twill weave comprising a repeating pattern of two fibrillated tape yarns in a first shed and a monofilament yarn in a second shed.

The woven geosynthetic fabric has comparable tensile strength. That is, the fabric has similar tensile strength values in both the warp (machine) direction and the weft (cross machine) direction at a specified elongation values. As discussed above, in one aspect, the woven fabric has a tensile strength in the warp direction of at least 100 pounds per inch (lb/in) at 2% strain and a tensile strength in the weft direction of at least 100 lb/in at 2% strain. In another aspect, the woven fabric has a tensile strength in the warp direction of at least 125 lb/in at 2% strain and a tensile strength in the weft direction of 125 lb/in at 2% strain. Still, in another aspect, the woven fabric has a tensile strength in the warp direction of at least 130 lb/in at 2% strain and a tensile strength in the weft direction of 130 lb/in at 2% strain. In other aspects, the woven fabric has a tensile strength in the warp direction of at least 200 lb/in at 5% strain and a tensile strength in the weft direction of at least 200 lb/in at 5% strain. In yet another aspect, the woven fabric has a tensile strength in the warp direction of at least 250 lb/in at 5% strain and a tensile strength in the weft direction of at least 250 lb/in at 5% strain. Still, in another aspect, the woven fabric has a tensile strength in the warp direction of at least 300 lb/in at 5% strain and a tensile strength in the weft direction of at least 300 lb/in at 5% strain. Still further, in another aspect, the woven fabric has a tensile strength in the warp direction of at least 350 lb/in at 5% strain and a tensile strength in the weft direction of at least 350 lb/in at 5% strain. Yet still, in another aspect, the woven fabric has a tensile strength in the warp direction of at least 400 lb/in at 5% strain and a tensile strength in the weft direction of at least 400 lb/in at 5% strain.

In some aspects, the woven fabric has a tensile strength in the warp direction of at least 100 lb/in at 2% strain and at least 200 lb/in at 5% strain, and a tensile strength in the weft direction of at least 100 lb/in at 2% strain and at least 200 lb/in at 5% strain, as measured in accordance with ASTM D4595. In other aspects, the woven fabric has a tensile strength in the warp direction of at least 125 lb/in at 2% strain and at least 250 lb/in at 5% strain, and a tensile strength in the weft direction of at least 125 lb/in at 2% strain and at least 250 lb/in at 5% strain, as measured in accordance with ASTM D4595.

The woven fabric has open channels through the fabric for water flow. With a woven fabric comprising a repeating pattern of two or more first weft yarns in a same first shed and one second weft yarn in a second shed, water is able to flow at a rate between about 5 and about 195 gallons per square foot per minute (gpm/ft$^2$) through the fabric. Water flow rate, as referenced herein, is measured in accordance with ASTM D4491. In another aspect, the woven fabric has a water flow rate between about 30 and about 150 gpm/ft$^2$ through the fabric. In another aspect, the woven fabric has a water flow rate of at least about 75 gpm/ft$^2$. In yet another aspect, the woven fabric has a water flow rate of at least about 80 gpm/ft$^2$, at least about 85 gpm/ft$^2$, at least about 90 gpm/ft$^2$, at least about 95 gpm/ft$^2$, or at least about 100 gpm/ft$^2$.

The woven fabric comprising a repeating pattern of two or more first weft yarns in a same first shed and one second weft yarn in a second shed has an apparent opening size (AOS) of at least 30. In one aspect, the woven fabric has an AOS of at least 35. And, in another aspect, the woven fabric has an AOS of at least 40.

Thus, the woven geosynthetic fabric has comparable tensile strength in combination with a pore size of at least 30 AOS and high waterflow. AOS, as referenced herein, is determined in accordance with ASTM International Standard D4751. In comparison, when only a monofilament weft (fill) yarn is used in the first and second shed, a fabric is produced with very high waterflow (e.g., 200 gpm/ft$^2$ or more), but with a very low AOS value, (e.g., 20 AOS or less). Further, when only multiple fibrillated taped yarns are placed in a single shed, the waterflow is very low, and when multiple monofilaments are placed in a single shed, the warp crimp is not reduced enough to allow for the desired combination of comparable tensile strength, at least 30 AOS, and waterflow of at least 75 gpm/ft$^2$.

The process for making fabrics, to include the above described woven geosynthetic fabric, is well known in the art. Thus, the weaving process employed can be performed on any conventional textile handling equipment suitable for producing the woven fabric. In weaving the woven geosynthetic fabric, the raised warp yarns are raised, and the lowered warp yarns are lowered, respectively, by the loom to open the shed. In one aspect, high modulus monofilament yarns are employed as the warp yarns, while high modulus fibrillated tape yarns and monofilament yarns are employed as the weft yarns. In some aspects, a method of making a woven geosynthetic fabric having a weft direction and a warp direction includes weaving weft yarns in the weft direction and warp yarns in the warp direction such that the warp yarns interweave the weft yarns in a plain weave pattern or a twill weave pattern. The woven geosynthetic fabric includes a repeating pattern of at least one first weft yarn disposed in a first shed and at least one second weft yarn in a second shed. The at least one first weft yarn and the at least one second weft yarn are different, and the second shed is taller than the first shed.

This disclosure is further illustrated by the following examples, which are non-limiting.

EXAMPLES

A number of different fabric samples were prepared and their properties were compared. The fabric samples were identified by AOS, waterflow, tensile strength, threads/inch, weave, warp yarns, and fill yarns.

The properties of the woven fabric were measured using standardized American Society for Testing and Materials International (ASTM International) test methods set forth in Table 1 below in effect at the time of filing of the instant application. The target tensile is directed to a theoretical commercial embodiment and should not be considered as limiting the scope of the description of the invention herein or to the appended claims.

TABLE 1

| Property | Test Method* | Units | Target Tensile, MD × CD |
|---|---|---|---|
| Wide Width (WW) tensile strength @2% Strain | ASTM D4595 | lb/in | 125 × 125 |
| Wide Width (WW) tensile strength @5% Strain | ASTM D4595 | lb/in | 250 × 250 |
| Apparent opening size (AOS) | ASTM D4751 | U.S. Sieve No. | 30-40 |
| Waterflow | ASTM D4491 | gal/min · ft$^2$ | 75 |

* The recited Test Method is the identified ASTM International Standard.

Examples 1-9

Examples 1-9 were used to provide a beginning, baseline set of data. The construction of and results for Examples 1-9 are provided in Table 2 below.

TABLE 2

| Property | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|
| Construction | 45 × 13.2 | 45 × 12.2 | 45 × 11.2 | 45 × 13.2 | 45 × 12.2 | 45 × 11.2 | 45 × 13.2 | 45 × 12.2 | 45 × 11.2 |
| Weave Pattern | 2/2 Twill | 2/2 Twill | 2/2 Twill | 3/1 Special | 3/1 Special | 3/1 Special | 3/3 Herring-bone | 3/3 Herring-bone | 3/3 Herring-bone |
| Warp Yarn | 1011 | 1011 | 1011 | 1011 | 1011 | 1011 | 1011 | 1011 | 1011 |
| Fill Yarn (tape) | 4602 | 4602 | 4602 | 4602 | 4602 | 4602 | 4602 | 4602 | 4602 |
| Fill Yarn (mono) | 925 | 925 | 925 | 925 | 925 | 925 | 925 | 925 | 925 |
| WW Tens@2% | 63 × 171 | 84 × 154 | 80 × 141 | 74 × 163 | n/a | 103 × 148 | 85 × 162 | n/a | 112 × 139 |
| WW Tens @5% | 177 × 352 | 154 × 216 | 141 × 220 | 163 × 226 | n/a | 148 × 278 | 162 × 250 | n/a | 139 × 292 |
| AOS | 40 | 40 | 40 | Fail 40 | n/a | Fail 40 | Fail 40 | n/a | Fail 40 |
| Waterflow | 111 | 101 | 107 | 162 | n/a | 179 | 124 | n/a | 146 |

Examples 5 and 8 were not tested since neither of the adjacent examples passed all specifications. As shown in Table 2, for each example, the tensile strengths in the 2% and 5% warp direction (machine direction, MD) were significantly below the desired tensile strengths of 125 and 250 lb/in respectively.

Examples 10-14

A variety of concepts were tested in Examples 10-14 as set forth in Table 3 below. Examples 10 and 11 are a 2/2 twill weave pattern of a monofilament having a 565 denier twisted together with fibrillated tape having a 4602 denier to make a single composite yarn for the fill, in the weft direction. Examples 12 and 13 are a special 3/1 twill pattern having a 3602 denier tape fill yarn in the weft direction in order to reduce some of the crimp in the MD yarns and maintain the CD tensile strength. Example 14 used the double layer weave pattern described in U.S. Pat. No. 8,598,054 to King et al., incorporated herein by reference in its entirety.

TABLE 3

| Property | Ex. 10 | Ex. 11 | Ex. 12 | Ex. 13 | Ex. 14 |
|---|---|---|---|---|---|
| Construction | 45 × 6 | 45 × 8 | 45 × 7.8 | 45 × 8.4 | 45 × 13 |
| Weave Pattern | 2/2 Twill | 2/2 Twill | 3/1 Special | 3/1 Special | Double Layer |
| Warp Yarn | 1011 | 1011 | 1011 | 1011 | 1011 |
| Fill Yarn (tape) | 565 mono & 4602 tape twisted together | 565 mono & 4602 tape twisted together | 3602 | 3602 | 3602 |
| Fill Yarn (mono) | | | none | none | 565 |
| WW Tens@2% | n/a | 85 × 130 | 137 × 114 | 135 × 120 | 93 × 150 |
| WW Tens @5% | n/a | 233 × 316 | 327 × 252 | 320 × 267 | 253 × 334 |
| AOS | n/a | Fail 40 | Fail 40 | Fail 40 | Fail 40/Pass 30 |
| Waterflow (gpm/ft$^2$) | n/a | 322 | 60 | 52 | 72 |

As shown in Table 3, the fabric of Examples 10 and 11, having a monofilament and fibrillated tape twisted together, had a low 2% MD tensile strength, failed for 40 AOS and had very high waterflow (322 gpm/ft$^2$). For Examples 12 and 13, the CD 2% and 5% tensile values of the fabrics were borderline to low, failed 40 AOS, and had low waterflow. With regard to Example 14, the fabric had excessive warp crimp, resulting in low 2% MD tensile values, and failed 40 AOS and low waterflow.

Examples 15-20

The materials, construction and test results for the fabrics of Examples 15-20, are shown in Table 4.

TABLE 4

| Property | Ex. 15 | Ex. 16 | Ex. 17 | Ex. 18 | Ex. 19 | Ex. 20 |
|---|---|---|---|---|---|---|
| Construction | 45 × 7.5 | 45 × 8.5 | 45 × 9 | 45 × 10 | 45 × 7 | 45 × 9 |
| Weave Pattern | 3/1 Special | 3/1 Special | 2/2 Twill - alt tape & mono | 2/2 Twill - alt tape & mono | 2/2 Twill - alt tape/tape/mono | 2/2 Twill - alt tape/tape/mono |

TABLE 4-continued

| Property | Ex. 15 | Ex. 16 | Ex. 17 | Ex. 18 | Ex. 19 | Ex. 20 |
|---|---|---|---|---|---|---|
| Warp Yarn | 1011 | 1011 | 1011 | 1011 | 1011 | 1011 |
| Fill Yarn (tape) | 3602 | 3602 | 5602 | 5602 | 4602 | 4602 |
| Fill Yarn (mono) | None | none | 925 | 925 | 925 | 925 |
| WW Tens@2% | n/a | n/a | 111 × 136 | 101 × 128 | 121 × 90 | 101 × 132 |
| WW Tens @5% | n/a | n/a | 276 × 281 | 258 × 298 | 300 × 212 | 265 × 287 |
| AOS | n/a | n/a | Fail 40 | Fail 40 | Fail 40 | Fail 40 |
| Waterflow | n/a | n/a | 132 | 128 | 124 | 115 |

As shown in Table 4, Examples 15 and 16 were a broken 3/1 twill weave, Examples 17 and 18 were a 2/2 twill weave pattern of an alternating single tape yarn and a single monofilament yarn in the weft (fill) direction. Examples 19 and 20 were a 2/2 twill weave pattern alternating a single tape yarn, single tape yarn, and single monofilament yarn in a weft direction. Examples 17 and 18 were directed toward increasing the 2% MD value by decreasing warp crimp and fabric interlacings, but were not successful. In addition, all of the examples failed 40 AOS.

Examples 21-26

The materials, construction and test results for Examples 21-26 are shown in Table 5 below. Examples 21 & 22 used a double layer weave pattern with two stuffer picks adjacent to one another (e.g. as described in King et al). Examples 23 and 24 used the weave pattern of earlier samples, 2/2 twill with alternating tape & monofilament fill yarns, and Examples 26 used a special 3/2 twill weave with alternating tape & monofilament fill yarns in order to further reduce warp crimp.

TABLE 5

| Property | Ex. 21 | Ex. 22 | Ex. 21A | Ex. 22A | Ex. 23 | Ex. 24 | Ex. 25 | Ex. 26 |
|---|---|---|---|---|---|---|---|---|
| Construction | 45 × 10 | 45 × 12 | 45 × 10 | 45 × 12 | 45 × 9 | 45 × 10 | 45 × 9 | 45 × 10 |
| Weave Pattern | Dbl Layer-2 Stuffer Pks | Dbl Layer-2 Stuffer Pks | Dbl Layer-2 Stuffer Pks | Dbl Layer-2 Stuffer Pks | 2/2 Twill - alt tape & mono | 2/2 Twill - alt tape & mono | Special 3/2 Twill - alt tape & mono | Special 3/2 Twill - alt tape & mono |
| Warp Yarn | 1011 | 1011 | 1011 | 1011 | 1011 | 1011 | 1011 | 1011 |
| Fill Yarn (tape) | 4602 | 4602 | 4602 | 4602 | 5602 | 5602 | 5602 | 5602 |
| Fill Yarn (mono) | 565 | 565 | 925 | 925 | 695 | 695 | 695 | 695 |
| WW Tens@2% | 106 × 157 | 109 × 175 | n/a | n/a | 106 × 128 | 100 × 151 | n/a | 115 × 148 |
| WW Tens @5% | 332 × 535 | 368 × 535 | n/a | n/a | 273 × 518 | 312 × 508 | n/a | 302 × 311 |
| AOS | Fail 40 | Fail 40 | n/a | n/a | Fail 40 | Fail 40 | n/a | Fail 40 |
| Waterflow | 109 | 95 | n/a | n/a | 129 | 128 | n/a | 130 |

Examples 21A and 22A were not tested because the double layer 2 stuffer pick weave pattern produced holes in the fabric and would not pass 40 AOS. As shown in Table 5, Examples 21 and 22 both had low 2% MD values due to the relative high level of warp crimp in this weave pattern. Both also failed for 40 AOS. Examples 23 and 24 both had low 2% MD values and failed 40 AOS. Example 26 had low 2% MD and failed 40 AOS.

Examples 27-31

The materials and construction of Examples 27-31 are shown below in Table 6. Examples 27, 27A, and 28 used a double layer weave pattern with two stuffer picks adjacent to one another. Examples 29-30 used a different weave pattern, consisting of two sections of different pick counts. It consisted of a section of monofilament picks at a higher density (for flow/AOS) and a section of fibrillated tape yarns at a lower density (for strength). Example 31 used a 865 denier nylon continuous filament yarn instead of a monofilament.

TABLE 6

| Property | Ex. 27 | Ex. 27A | Ex. 28 | Ex. 29 | Ex. 30 | Ex. 31 |
|---|---|---|---|---|---|---|
| Construction | 45 × 7 | 45 × 10 | 45 × 9 | 45 × 16/6.8 | 45 × 16/6.5 | 45 × 116/6.8 |
| Weave Pattern | Dbl Layer - 2 Stuffer Pks | Dbl Layer - 2 Stuffer Pks | Dbl Layer - 2 Stuffer Pks | Special - 2 pk counts | Special - 2 pk counts | Special - 2 pk counts |
| Warp Yarn | 1011 | 1011 | 1011 | 1011 | 1011 | 1011 |

TABLE 6-continued

| Property | Ex. 27 | Ex. 27A | Ex. 28 | Ex. 29 | Ex. 30 | Ex. 31 |
|---|---|---|---|---|---|---|
| Fill Yarn (tape) | 5602 | 5602 | 5602 | 5602 | 5602 | 5602 |
| Fill Yarn (mono) | 925 | 925 | 925 | 925 | 925 | 865* |
| WW Tens@2% | n/a | n/a | 132 × 175 | 79 × 160 | 122 × 145 | 86 × 101 |
| WW Tens @5% | n/a | n/a | 318 × 368 | 230 × 325 | 305 × 288 | 244 × 227 |
| AOS | n/a | n/a | Fail 40 | Fail 40 | Fail 40 | Fail 40 |
| Waterflow | n/a | n/a | 160 | 137 | 140 | 99 |

Examples 27 and 27A were not tested. Example 28 had marginal 2% MD values due to the relative high level of warp crimp inherent in this weave pattern. It also failed for 40 AOS. Examples 29-30 did not meet the 2% MD value and failed 40 AOS, while Example 31 offered no improvement in physical properties.

This concluded this series of prototypes. It was determined that the 1011 denier warp yarn needed to be heavier in order to increase the 2% and 5% MD tensile strength.

Examples 32-59: PC-1C-14-304-01B

A 1362 Denier high modulus, high tensile warp yarn was used in the following series of examples for PC-1C-14-304-01B.

Examples 32-37

Examples 32-37 are provided in Table 7 below. As shown in Table 7, Examples 32, 34, 35, and 37 were low (do not make 125 lb/in tensile strength) on 2% CD, while Examples 33, 34, 36, and 37 were low or marginally low (do not make 125 lb/in MARV) on 2% MD.

TABLE 7

| Property | Ex. 32 (Trial 1) | Ex. 33 (Trial 2) | Ex. 34 (Trial 3) | Ex. 35 (Trial 4) | Ex. 36 (Trial 5) | Ex. 37 (Trial 6) |
|---|---|---|---|---|---|---|
| Construction | 45 × 9 | 45 × 10 | 45 × 11 | 45 × 9 | 45 × 10 | 45 × 11 |
| Weave Pattern | 2/2 Twill - alt tap & mono | 2/2 Twill - alt tape & mono | 2/2 Twill - alt tape & mono | 2/2 Twill - alt tape & mono | 2/2 Twill - alt tape & mono | 2/2 Twill - alt tape & mono |
| Warp Yarn | 1362 | 1362 | 1362 | 1362 | 1362 | 1362 |
| Fill Yarn (tape) | 5602 | 5602 | 5602 | 5602 | 5602 | 5602 |
| Fill Yarn (mono) | 565 | 565 | 565 | 695 | 695 | 695 |
| WW Tens@2% | 150 × 118 | 136 × 150 | 122 × 89 | 151 × 95 | 123 × 142 | 110 × 69 |
| WW Tens @5% | 389 × 247 | 349 × 295 | 306 × 192 | 368 × 199 | 315 × 303 | 283 × 345 |
| AOS | Fail 40/Pass 30 | Fail 40/Pass 30 | Fail 40 | Fail 40 | Fail 40 | Fail 40 |
| Waterflow | 115 | 110 | 121 | 130 | 121 | 111 |

Examples 38-45

Examples 38, 39, 40, 41, and 42 used a smaller monofilament fill yarn (425 denier) than previous trials, in an attempt to improve the MD modulus by reducing warp crimp (Table 8). A new weave pattern was created in Examples 43 and 44 using a 2/2 twill based, but with alternating 2 tape yarns in the same shed, with one monofilament yarn in the next (adjacent) shed. This was done in an effort to decrease the warp crimp and fabric interlacings to increase MD modulus. Example 45 once again used the double layer weave pattern (with the 1362 Denier warp yarn).

TABLE 8

| Property | Ex. 38 (Trial 7) | Ex. 39 (Trial 8) | Ex. 40 (Trial 9) | Ex. 41 (Trial 9A) | Ex. 42 (Trial 10) | Ex. 43 (Trial 11) | Ex. 44 (Trial 12) | Ex. 45 (Trial 13) |
|---|---|---|---|---|---|---|---|---|
| Construction | 45 × 9 | 45 × 11 | 45 × 10 | 45 × 11 | 45 × 12 | 45 × 10 | 45 × 12 | 45 × 14 |
| Weave Pattern | 2/2 Twill - alt tape & mono | 2/2 Twill - alt tape & mono | 2/2 Twill - alt tape & mono | 2/2 Twill - alt tape & mono | 2/2 Twill - alt tape & mono | 2/2 Twill - alt 2 tape in 1 shed & 1 mono shed | 2/2 Twill - alt 2 tape in 1 shed & 1 mono shed | Double Layer |
| Warp Yarn | 1362 | 1362 | 1362 | 1362 | 1362 | 1362 | 1362 | 1362 |
| Fill Yarn (tape) | 5602 | 5602 | 4602 | 4602 | 4602 | 4602 | 4602 | 5602 |
| Fill Yarn (mono) | 425 | 425 | 425 | 425 | 425 | 565 | 565 | 565 |

TABLE 8-continued

| Property | Ex. 38 (Trial 7) | Ex. 39 (Trial 8) | Ex. 40 (Trial 9) | Ex. 41 (Trial 9A) | Ex. 42 (Trial 10) | Ex. 43 (Trial 11) | Ex. 44 (Trial 12) | Ex. 45 (Trial 13) |
|---|---|---|---|---|---|---|---|---|
| WW Tens@2% | 151 × 141 | 111 × 154 | 144 × 115 | 105 × 156 | 110 × 138 | 231 × 156 | 196 × 192 | 107 × 139 |
| WW Tens @5% | 387 × 262 | 302 × 328 | 366 × 248 | 296 × 329 | 288 × 296 | 508 × 318 | 457 × 369 | 309 × 320 |
| AOS | Fail 40/Pass30 | Fail 40 | Fail 40 | Fail 40 | Pass 40 | Fail 30 | Fail 40/Pass 30 | Fail 40 |
| Waterflow | 108 | 109 | 120 | 113 | 97 | 109 | 102 | 102 |

Examples 38-42 were only marginally successful in improving the MD modulus by reducing warp crimp, as Examples 39, 41, and 42 were less than 125 lb/in at 2% MD, and Examples 38 and 40 were acceptable. For Examples 43 and 44, the 2% MD values were very good (231 and 196 lb/in, respectively), however, the AOS failed at 30 for Example 43 and failed at 40 for Example 44. While Example 45 used the double layer weave pattern described in U.S. Pat. No. 8,589,054 to King et al., which is incorporated herein in its entirety by reference, it again failed to reach the target tensile strength at 2% MD and 40 AOS. However, it did successfully provide 30 AOS and tensile strength in the warp and weft directions as measured at 2% strain of at least 100 lb/in.

The following examples were targeted at 30 AOS, a waterflow of 75 gpm/ft$^2$, and tensile strength values of 125×125 at 2% strain and 250×250 at 5% strain. Smaller AOS, such as 40 AOS, can be achieved by employing a small denier tape or monofilament in the range of about 350 denier to about 2,000 denier in the first shed and/or two monofilaments respectively being in the range of about 1,600 denier to about 6,500 denier in the second shed.

Examples 46-53

Examples 46-53 were a 2/2 twill weave alternating two fill yarns in the same first shed, with one monofilament fill yarn in the second (adjacent) shed (Table 9). Examples 46, 47, 48, and 49 used a 4000 denier (continuous filament) polyester yarn substituted for the fibrillated PP tapes previously used. Examples 50-53 used a 3602 denier tape polypropylene yarn in fill direction with either a 565 or 425 denier monofilament.

TABLE 9

| Property | Ex. 46 Trial 11A | Ex. 47 Trial 12A | Ex. 48 Trial 13A | Ex. 49 Trial 14 | Ex. 50 Trial 15 | Ex. 51 Trial 16 | Ex. 52 Trial 17 | Ex. 53 Trial 18 |
|---|---|---|---|---|---|---|---|---|
| Construction | 45 × 11 | 45 × 13 | 45 × 11 | 45 × 13 | 45 × 12 | 45 × 14 | 45 × 12 | 45 × 14 |
| Weave Pattern | 2/2 Twill - alt cont. fil & mono | 2/2 Twill - alt cont. fil & mono | 2/2 Twill - alt cont. fil & mono | 2/2 Twill - alt cont. fil & mono | 2/2 Twill - alt tape & mono | 2/2 Twill - alt tape & mono | 2/2 Twill - alt tape & mono | 2/2 Twill - alt tape & mono |
| Warp Yarn | 1362 | 1362 | 1362 | 1362 | 1362 | 1362 | 1362 | 1362 |
| Fill Yarn (tape) | 4000 | 4000 | 4000 | 4000 | 3602 | 3602 | 3602 | 3602 |
| Fill Yarn (mono) | 565 | 565 | 425 | 425 | 565 | 565 | 425 | 425 |
| WW Tens@2% | 129 × 75 | 97 × 89 | 116 × 74 | 94 × 85 | 100 × 94 | 74 × 109 | 99 × 89 | 77 × 100 |
| WW Tens @5% | 340 × 198 | 255 × 241 | 322 × 196 | 256 × 229 | 280 × 206 | 202 × 238 | 277 × 198 | 225 × 222 |
| AOS | Fail 40 | Fail 40 | Fail 40 | Fail 40 | Pass 40 | Pass 40 | Pass 40 | Pass 40 |
| Waterflow | 165 | 160 | 155 | 148 | 108 | 95 | 103 | 82 |

For Examples 46-53, using the 4000 denier (continuous filament) polyester yarn, it was thought the higher yarn modulus of the polyester yarn would carry over into the fabric CD, allowing for the use of lower pick density, and therefore lower warp crimp and higher MD modulus. However, as shown in Table 9, none of these trials passed the 2% CD specification. Also, the pick density and interlacings were too high, resulting in low 2% MD values. Examples 50-53 all passed for 40 AOS, however, all were low on the 2% MD values, due to the high warp crimp resulting from the single picks in each shed and relatively high pick densities of 12-14 ppi.

Examples 54-59

A variety of concepts were tested in Examples 54-59 as set forth in Table 10 below.

TABLE 10

| Property | Ex. 54 (Trial 19) | Ex. 55 (Trial 20) | Ex. 56 (Trial 20A) | Ex. 57 (Trial 21) | Ex. 58 (Trial 22) | Ex. 59 (Trial 23) |
|---|---|---|---|---|---|---|
| Construction | 45 × 9 | 45 × 14 | 45 × 12 | 45 × 13 | 45 × 12.5 | 45 × 12 |
| Weave Pattern | 2/2 Twill - alt tape & mono | 2/2 Twill - alt 2 tape in 1 shed & 1 mono shed | 2/2 Twill - alt 2 tape in 1 shed & 1 mono shed | 2/2 Twill - alt 2 tape in 1 shed & 1 mono shed | 2/2 Twill - alt 2 tape in 1 shed & 1 mono shed | 2/2 Twill - alt 3 tape in 1 shed & 1 mono shed |

TABLE 10-continued

| Property | Ex. 54 (Trial 19) | Ex. 55 (Trial 20) | Ex. 56 (Trial 20A) | Ex. 57 (Trial 21) | Ex. 58 (Trial 22) | Ex. 59 (Trial 23) |
|---|---|---|---|---|---|---|
| Warp Yarn | 1362 | 1362 | 1362 | 1362 | 1362 | 1362 |
| Fill Yarn (tape) | 5602 | 4602 | 4602 | 4602 | 4602 | 4602 |
| Fill Yarn (mono) | 525* | 565 | 565 | 565 | 565 | 565 |
| WW Tens@2% | 165 × 127 | 123 × 201 | 139 × 177 | 142 × 193 | 136 × 205 | 171 × 211 |
| WW Tens @5% | 418 × 265 | 336 × 433 | 377 × 378 | 365 × 410 | 365 × 431 | 433 × 437 |
| AOS | Pass 30 Fail 40 | Pass 30 Fail 40 | Pass 30 Fail 40 | Pass 30 Fail 40 | Pass 30 Fail 40 | Fail 30 |
| Waterflow | 97 | 89 | 96 | 91 | 97 | 100 |

Example 54 used an oval shaped 525 denier monofilament in fill (rather than round shapes used in all other trials). No improvement in properties was noticed for Example 54.

Examples 55 and 56 were very similar to previous Example 44 and results were also very similar, providing a preliminary small scale validation of the construction. Example 57 was then run at 13 picks per inch to optimize the construction. A 100 LYD roll of Example 57 was run, and the Tensile Strength values of 2% MD averaged above 125 lb/in. (See Table 10 above).

Then Examples 58 and 59 were run. The data for Example 58 looked good. Example 59 used yet another different weave pattern in which 3 picks of tape yarn were put into a single shed, rather than 2 picks in a shed. This resulted in greatly improved 2% MD values due to the reduction in interlacings, however, the pores in the fabric were much larger, and as a result, the fabric failed 30 AOS.

Table 11 below shows detailed results of the 100 yard (yd) roll of Example 57, with the original prototype sample included for comparison.

TABLE 11

| Property | Ex. 57 (Trial 21) prototype | 100 yd roll; sample #1 | 100 yd roll; sample #2 | 100 yd roll; sample #3 | 100 yd roll; sample #4 | 100 yd roll; sample #5 | 100 yd roll; sample #6 | AVG |
|---|---|---|---|---|---|---|---|---|
| WW Tens@2% | 142 × 193 | 124 × 192 | 125 × 193 | 121 × 200 | 123 × 198 | 134 × 200 | 135 × 198 | 129 × 196 |
| WW Tens @5% | 365 × 410 | 336 × 407 | 338 × 410 | 336 × 416 | 338 × 415 | 361 × 421 | 358 × 414 | 347 × 413 |
| AOS | Pass 30 | Pass 30 | Pass 30 | Pass 30 | Pass 30 | Pass 30 | Pass 30 | Pass 30 |
| Waterflow | 91 | 97 | 98 | 97 | 112 | 94 | 105 | 99 |

Table 12 below shows detailed results of the 100 yard (yd) roll of Example 58, with the original prototype sample included for comparison.

TABLE 12

| | ASTM Test Method | NEW SPECS | Ex. 58 1st sample (prototype) | Sample #1 | Sample #2 | Sample #3 | Sample #4 | Sample #5 | AVG |
|---|---|---|---|---|---|---|---|---|---|
| Grab, MD | D4632 | | 905 | 943 | 985 | 1026 | 995 | 989 | 974 |
| Grab, CD | D4632 | | 505 | 533 | 507 | 483 | 508 | 517 | 509 |
| Grab Elong MD | D4632 | | 15.0 | 16.8 | 16.5 | 17.8 | 17.2 | 17.6 | 16.8 |
| Grab Elong CD | D4632 | | 8.0 | 8.1 | 7.5 | 7.8 | 7.9 | 8.3 | 7.9 |
| WW Ult (lb/in) MD | D4595 | 400 | 813 | 776 | 806 | 799 | 775 | 796 | 794 |
| WW Ult (lb/in) CD | D4595 | 400 | 470 | 474 | 429 | 425 | 441 | 475 | 452 |
| WW Elong MD | D4595 | | 11.6 | 10.4 | 11.3 | 10.7 | 10.3 | 11.3 | 10.9 |
| WW Elong CD | D4595 | | 5.8 | 6.2 | 5.8 | 5.4 | 5.6 | 6.4 | 5.9 |
| WW 2% MD | D4595 | 125 | 136 | 142 | 141 | 155 | 149 | 149 | 145 |
| WW 2% CD | D4595 | 125 | 205 | 196 | 188 | 202 | 214 | 193 | 200 |
| WW 5% MD | D4595 | 250 | 365 | 382 | 378 | 395 | 392 | 381 | 382 |
| WW 5% CD | D4595 | 250 | 431 | 422 | 396 | 372 | 374 | 409 | 401 |
| WW 10% MD | D4595 | | 736 | 759 | 749 | 770 | 740 | 742 | 749 |
| WW 10% CD | D4595 | | — | — | — | — | — | — | — |
| WW Seam | D4595 | | — | — | — | — | — | — | — |
| CBR (lb) | — | | 2765 | | 2531 | 2805 | 2839 | 2714 | 2731 |
| Trap Tear, MD | D6241 | | 363 | 373 | 391 | 365 | 411 | 386 | 382 |
| Trap Tear, CD | D4533 | | 233 | 299 | 230 | 235 | 257 | 246 | 250 |
| AOS | D4533 | 30 | P30(1.8%) F40(93%) | P30(1.6%) F40(95%) | P30(0.4%) F40(46%) | P30(2.8%) 40(92%) | P30(2.0%) F40(93%) | P30(0.0%) F40(64%) | P30 |
| Opening Size | D4751 | 0.600 | — | 0.594 | 0.581 | 0.595 | 0.594 | 0.586 | 0.590 |
| Permitivitty | D4751 | | 1.317 | 1.664 | 1.230 | 1.587 | 1.472 | 1.392 | 1.444 |
| Permeability | | | 0.226 | 0.266 | 0.204 | 0.258 | 0.227 | 0.223 | 0.234 |
| Flow Rate | D4491 | 75 | 97 | 123 | 91 | 117 | 108 | 103 | 107 |
| Weight | D4491 | | 13.9 | 13.7 | 13.7 | 13.4 | 13.8 | 13.7 | 13.7 |
| Thickness | D4491 | | 68 | 63 | 65 | 63 | 61 | 63 | 64 |

In order to show the benefits of mixing monofilament and tape fill yarns, the following Examples were run (Table 13). Trials PA14 & PA 15 were made with 12 picks/inch, while PA18 and PA19 were made with 13 picks/inch.

Trials PA14 and PA18 used only 565 denier round monofilament in fill direction, while Trials PA15 and PA19 used ONLY 4602 denier fibrillated tape in fill direction. The weave patterns on all PA14, PA15, PA18 and PA19 were same as Examples 57 and 58 detailed above

TABLE 13

| Property | Trial PA14 | Trial PA15 | Trial PA18 | Trial PA19 |
|---|---|---|---|---|
| Construction | 45 × 12 | 45 × 12 | 45 × 13 | 45 × 13 |
| Weave Pattern | 2/2 Twill - alt 2 mono in 1 shed & 1 mono shed | 2/2 Twill - alt 2 tape in 1 shed & 1 tape shed | 2/2 Twill - alt 2 mono in 1 shed & 1 mono shed | 2/2 Twill - alt 3 tape in 1 shed & 1 tape shed |
| Warp Yarn | 1362 | 1362 | 1362 | 1362 |
| Fill Yarn (tape) | NONE | 4602 | NONE | 4602 |
| Fill Yarn (mono) | 565 | NONE | 565 | NONE |
| WW Tens@2% | 167 × 13 | 130 × 271 | 164 × 15 | 105 × 285 |
| WW Tens @5% | 404 × 32 | 355 × 568 | 410 × 35 | 310 × 598 |
| AOS | Fail 30 | Pass 30 | Pass 30 | Pass 30 |
| Waterflow | 210 | 46 | 211 | 45 |

As shown in Table 13, when using only 565 denier monofilament in fill, 2% and 5% MD values are very low (i.e. <50 lb/in), waterflow is very high (<200 gpm/ft$^2$), and AOS is passed at 30 AOS. When using only the 4602 denier fibrillated tape in fill, all tensile values are very high, AOS values pass for 30 AOS, and waterflow is low (<50 gpm/ft$^2$).

A comparison of Example 57 with Trials PA18 and PA19 is provided in Table 14 below.

TABLE 14

| | Test Method | Trial 21 | Trial PA18 | Trial PA19 |
|---|---|---|---|---|
| Warp Yarn Denier | — | 1360 | 1360 | 1360 |
| Warp Yarn Ends/Inch | — | 45 | 45 | 45 |
| Fill Yarn Denier Monofilament | — | 565 | 565 | None |
| Fill Yarn Picks/Inch Monofilament | — | 4.3 | 13 | None |
| Fill Yarn Denier Fibrillated Tape | — | 4600 | None | 4600 |
| Fill Yarn Picks/Inch Fibrillated Tape | — | 8.7 | None | 13 |
| Total Fill Picks/Inch | — | 13 | 13 | 13 |
| Weave Pattern | — | 2/2 Twill-alternating 1 pk/shed & 2 pks/shed | 2/2 Twill-alternating 1 pk/shed & 2 pks/shed | 2/2 Twill-alternating 1 pk/shed & 2 pks/shed |
| Wide Width Tensile @ 2% Strain, lb/in (MD × CD) | ASTM D4595 | 142 × 193 | 164 × 15 | 105 × 285 |
| Wide Width Tensile @ 5% Strain, lb/in (MD × CD) | ASTM D4595 | 365 × 410 | 410 × 35 | 310 × 598 |
| Waterflow, gpm/ft$^2$ | ASTM D4491 | 91 | 211 | 45 |
| AOS, U.S. Sieve | ASTM D4751 | 30 | 30 | 30 |

As show in Table 14, when two different fill yarns are used in a single material, in the prescribed fashion, all of the desired properties can be obtained in one single material (Ref Example 57), e.g., comparable tensile strength of 125×125 lb/in @2% strain, 250×250 lb/in @5% strain, 30 AOS, and 75 gpm/ft$^2$ flow rate.

Alternatively, if a single fill yarn is used, the desired properties cannot be obtained in a single material (refer to Trial PA19). Trial PA18 was produced with the same weave pattern and pick density as Example 57, only using the 565 denier monofilament in the fill direction. No tape yarn was used in the fill direction. Trial PA18 did achieve the high flow (211 gpm/ft$^2$) and 30 AOS, but the CD tensile strength values were very low (15 lb/in @2% strain, and 35 lb/in @5% strain).

Trial PA19 was produced with same weave pattern and pick density as Example 57 but used a 4600 denier fibrillated tape yarn in the fill direction (i.e., no monofilament yarn was used in the fill direction). Trial PA19 did achieve the desired tensile strength values in the CD and 30 AOS, however, the waterflow of 46 gpm/ft$^2$ was below the desired level of 75 gpm/ft$^2$.

As shown in Table 15, the differences in heights between the first and second sheds in 2/2 twill weave fabrics were measured. The Peak (P) height of the first shed and the Valley (V) height of the second shed were measured, and the % difference was calculated ((P−V/P). In each fabric, the first shed (fill yarn 1) included a tape, and the second shed (fill yarn 2) included a round monofilament. The % difference in heights (thicknesses) of the sheds ranged from 21% to 52%.

TABLE 15

| Construction | Weave pattern | Warp Yarn | Fill Yarn 1 | Fill Yarn 2 | Peak (P) (mils) | Valley (V) (mils) | % Difference (P − V)/P |
|---|---|---|---|---|---|---|---|
| 45 × 13.2 | 2/2 Twill | 1011 den oval monofil | 4600 den tape | 925 den round mono | 51 | 36 | 29% |
| 45 × 12.2 | 2/2 Twill | 1011 den oval monofil | 4600 den tape | 925 den round mono | 52 | 32 | 38% |
| 45 × 11.2 | 2/2 Twill | 1011 den oval monofil | 4600 den tape | 925 den round mono | 50 | 31 | 38% |
| 45 × 9 | 2/2 Twill | 1011 den oval monofil | 5600 den tape | 925 den round mono | 49 | 32 | 35% |
| 45 × 10 | 2/2 Twill | 1011 den oval monofil | 5600 den tape | 925 den round mono | 51 | 38 | 25% |
| 45 × 9 | 2/2 Twill | 1011 den oval monofil | 5600 den tape | 695 den round mono | 49 | 34 | 31% |
| 45 × 10 | 2/2 Twill | 1011 den oval monofil | 5600 den tape | 695 den round mono | 48 | 33 | 31% |
| 45 × 9 | 2/2 Twill | 1362 den oval monofil | 5600 den tape | 565 den round mono | 54 | 36 | 33% |
| 45 × 10 | 2/2 Twill | 1362 den oval monofil | 5600 den tape | 565 den round mono | 56 | 36 | 36% |
| 45 × 11 | 2/2 Twill | 1362 den oval monofil | 5600 den tape | 565 den round mono | 53 | 39 | 26% |
| 45 × 9 | 2/2 Twill | 1362 den oval monofil | 5600 den tape | 695 den round mono | 54 | 38 | 30% |
| 45 × 10 | 2/2 Twill | 1362 den oval monofil | 5600 den tape | 695 den round mono | 55 | 37 | 33% |
| 45 × 11 | 2/2 Twill | 1362 den oval monofil | 5600 den tape | 695 den round mono | 58 | 38 | 34% |
| 45 × 9 | 2/2 Twill | 1362 den oval monofil | 5600 den tape | 425 den round mono | 57 | 34 | 40% |
| 45 × 11 | 2/2 Twill | 1362 den oval monofil | 5600 den tape | 425 den round mono | 53 | 35 | 34% |
| 45 × 10 | 2/2 Twill | 1362 den oval monofil | 4600 den tape | 425 den round mono | 54 | 33 | 39% |
| 45 × 11 | 2/2 Twill | 1362 den oval monofil | 4600 den tape | 425 den round mono | 54 | 34 | 37% |
| 45 × 12 | 2/2 Twill | 1362 den oval monofil | 4600 den tape | 425 den round mono | 59 | 37 | 37% |
| 45 × 13 | 2/2 Twill | 1362 den oval monofil | 4000 den multifil | 425 den round mono | 48 | 38 | 21% |
| 45 × 12 | 2/2 Twill | 1362 den oval monofil | 3600 den tape | 565 den round mono | 48 | 37 | 23% |
| 45 × 14 | 2/2 Twill | 1362 den oval monofil | 3600 den tape | 565 den round mono | 51 | 36 | 29% |
| 45 × 12 | 2/2 Twill | 1362 den oval monofil | 3600 den tape | 425 den round mono | 50 | 34 | 32% |
| 45 × 14 | 2/2 Twill | 1362 den oval monofil | 3600 den tape | 425 den round mono | 49 | 33 | 33% |
| 45 × 14 | 2/2 Twill-1&2/shed | 1362 den oval monofil | 4600 den tape | 565 den round mono | 75 | 49 | 35% |
| 45 × 12 | 2/2 Twill-1&2/shed | 1362 den oval monofil | 4600 den tape | 565 den round mono | 66 | 44 | 33% |
| 45 × 13 | 2/2 Twill-1&2/shed | 1362 den oval monofil | 4600 den tape | 565 den round mono | 64 | 45 | 30% |
| 45 × 12.5 | 2/2 Twill-1&2/shed | 1362 den oval monofil | 4600 den tape | 565 den round mono | 61 | 36 | 41% |
| 45 × 12 | 2/2 Twill-1&3/shed | 1362 den oval monofil | 4600 den tape | 565 den round mono | 82 | 39 | 52% |
| 57 × 11.5 | 2/2 Twill-1&2/shed | 1011 den oval monofil | 4600 den tape | 565 den round mono | 58 | 46 | 21% |

The compositions, methods, and articles can alternatively comprise, consist of, or consist essentially of, any appropriate components or steps herein disclosed. The compositions, methods, and articles can additionally, or alternatively, be formulated so as to be devoid, or substantially free, of any steps, components, materials, ingredients, adjuvants, or species that are otherwise not necessary to the achievement of the function or objectives of the compositions, methods, and articles.

All ranges disclosed herein are inclusive of the endpoints, and the endpoints are independently combinable with each other. "Combinations" is inclusive of blends, mixtures, alloys, reaction products, and the like. The terms "first," "second," and the like, do not denote any order, quantity, or importance, but rather are used to distinguish one element from another. The terms "a" and "an" and "the" do not denote a limitation of quantity, and are to be construed to cover both the singular and the plural, unless otherwise indicated herein or clearly contradicted by context. "Or" means "and/or" unless clearly stated otherwise.

Reference throughout the specification to "one aspect", "another aspect", and so forth, means that a particular element (e.g., feature, structure, and/or characteristic) described in connection with the aspect is included in at least one aspect described herein, and may or may not be present in other aspects. In addition, it is to be understood that the described elements may be combined in any suitable manner in the various aspects.

In general, the compositions or methods may alternatively comprise, consist of, or consist essentially of, any appropriate components or steps herein disclosed. The invention may additionally, or alternatively, be formulated so as to be devoid, or substantially free, of any components, materials, ingredients, adjuvants, or species, or steps used in the prior art compositions or that are otherwise not necessary to the achievement of the function and/or objectives of the present claims.

The terms "first," "second," and the like, "primary," "secondary," and the like, as used herein do not denote any order, quantity, or importance, but rather are used to distinguish one element from another. The terms "front," "back," "bottom," and/or "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

Unless defined otherwise, technical and scientific terms used herein have the same meaning as is commonly understood by one of skill in the art to which this application belongs. All cited patents, patent applications, and other references are incorporated herein by reference in their entirety. However, if a term in the present application contradicts or conflicts with a term in the incorporated reference, the term from the present application takes precedence over the conflicting term from the incorporated reference.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A woven geosynthetic fabric having a weft direction and a warp direction, comprising:

weft yarns woven in the weft direction and warp yarns woven in the warp direction interweaving the weft yarns in a plain weave pattern or a twill weave pattern; and a repeating pattern of at least one first weft yarn disposed in a first shed and at least one second weft yarn in a second shed, the at least one first weft yarn and the at least one second weft yarn being different, and the second shed being taller than the first shed;

wherein the woven geosynthetic fabric has an apparent opening size (AOS) of at least 30 as measured in accordance with ASTM International Standard D4751 and a water flow rate of at least 75 gpm/ft$^2$ as measured in accordance with ASTM International Standard D4491; and wherein the woven geosynthetic fabric has a tensile strength of at least 100 lb/in at 2% strain in both the warp and weft directions as respectively measured in accordance with ASTM International Standard D4595.

2. The woven geosynthetic fabric of claim 1, wherein the at least one first weft yarn or the at least one second weft yarn is a monofilament yarn.

3. The woven geosynthetic fabric of claim 2, wherein the monofilament yarn has a round cross-sectional shape.

4. The woven geosynthetic fabric of claim 2, wherein the monofilament yarn has a non-round cross-sectional shape.

5. The woven geosynthetic fabric of claim 1, wherein the at least one first weft yarn or the at least one second weft yarn has a multichannel, tri-lobal, or pillow cross-sectional shape.

6. The woven geosynthetic fabric of claim 1, wherein the at least one first weft yarn and the at least one second weft yarn have different cross-sectional shapes.

7. The woven geosynthetic fabric of claim 1, wherein the weft yarns or warp yarns are, independently, an acrylic acid polymer, an aramid polymer, a fluoropolymer, a high density polyethylene, a low density polyethylene, a linear low density polyethylene, a polyacrylonitrile, a polyamide, a polybutylene terephthalate, a polycarbonate, a polyetherimide, a polyethylene copolymer, a polyethylene terephthalate, a polytetrafluoroethylene, a polyimide, a polylactic acid, a polyolefin, a polyphenylene, a polyphenylene oxide, a polyphenylene sulfide, a polyolefin, a polypropylene, a polypropylene/ethylene copolymer, a polystyrene, a polyurethane, a vinyl polymer, or any combination thereof.

8. The woven geosynthetic fabric of claim 1, wherein the first shed includes one weft yarn, and the second shed includes two weft yarns.

9. The woven geosynthetic fabric of claim 1, wherein the first shed includes two weft yarns, and the second shed includes two weft yarns.

10. The woven geosynthetic fabric of claim 1, wherein the first shed includes one weft yarn, and the second shed includes three weft yarns.

11. A woven geosynthetic fabric having a weft direction and a warp direction, comprising:

weft yarns woven in the weft direction and warp yarns woven in the warp direction interweaving the weft yarns in a plain weave pattern or a twill weave pattern; and a repeating pattern of at least one first weft yarn disposed in a first shed and at least one second weft yarn in a second shed, the at least one first weft yarn and the at least one second weft yarn having different surface areas, and the second shed being taller than the first shed;

wherein the woven geosynthetic fabric has an apparent opening size (AOS) of at least 30 as measured in accordance with ASTM International Standard D4751 and a water flow rate of at least 75 gpm/ft$^2$ as measured in accordance with ASTM International Standard D4491; and wherein the woven geosynthetic fabric has a tensile strength of at least 100 lb/in at 2% strain in both the warp and weft directions as respectively measured in accordance with ASTM International Standard D4595.

12. The woven geosynthetic fabric of claim 11, wherein the at least one first weft yarn or the at least one second weft yarn is a texturized yarn, a continuous filament yarn, a staple yarn, a spun yarn, a twisted yarn, an air tacking yarn, or any combination thereof.

13. The woven geosynthetic fabric of claim 11, wherein the at least one first weft yarn or the at least one second weft yarn is a monofilament yarn.

14. The woven geosynthetic fabric of claim 13, wherein the monofilament yarn has a round cross-sectional shape.

15. The woven geosynthetic fabric of claim 13, wherein the monofilament yarn has a non-round cross-sectional shape.

16. The woven geosynthetic fabric of claim 11, wherein the weft yarns or warp yarns are, independently, an acrylic acid polymer, an aramid polymer, a fluoropolymer, a high density polyethylene, a low density polyethylene, a linear low density polyethylene, a polyacrylonitrile, a polyamide, a polybutylene terephthalate, a polycarbonate, a polyetherimide, a polyethylene copolymer, a polyethylene terephthalate, a polytetrafluoroethylene, a polyimide, a polylactic acid, a polyolefin, a polyphenylene, a polyphenylene oxide, a polyphenylene sulfide, a polyolefin, a polypropylene, a polypropylene/ethylene copolymer, a polystyrene, a polyurethane, a vinyl polymer, or any combination thereof.

17. The woven geosynthetic fabric of claim 11, wherein the first shed includes one weft yarn, and the second shed includes two weft yarns.

18. The woven geosynthetic fabric of claim 11, wherein the first shed includes two weft yarns, and the second shed includes two weft yarns.

19. The woven geosynthetic fabric of claim 11, wherein the first shed includes one weft yarn, and the second shed includes three weft yarns.

20. A method of making a woven geosynthetic fabric having a weft direction and a warp direction, the method comprising:

weaving weft yarns in the weft direction and warp yarns in the warp direction such that the warp yarns interweave the weft yarns in a plain weave pattern or a twill weave pattern, the woven geosynthetic fabric including a repeating pattern of at least one first weft yarn disposed in a first shed and at least one second weft yarn in a second shed, the at least one first weft yarn and the at least one second weft yarn being different, and the second shed being taller than the first shed;

wherein the woven geosynthetic fabric has an apparent opening size (AOS) of at least 30 as measured in accordance with ASTM International Standard D4751 and a water flow rate of at least 75 gpm/ft$^2$ as measured in accordance with ASTM International Standard D4491; and wherein the woven geosynthetic fabric has a tensile strength of at least 100 lb/in at 2% strain in both the warp and weft directions as respectively measured in accordance with ASTM International Standard D4595.

21. The method of claim 20, wherein the at least one first weft yarn and the at least one second weft yarn have different surface areas.

22. The woven geosynthetic fabric of claim 1, wherein the at least one first weft yarn disposed in the first shed and the at least one second weft yarn in the second shed are in-plane with one another.

23. The woven geosynthetic fabric of claim 11, wherein the at least one first weft yarn disposed in the first shed and the at least one second weft yarn in the second shed are in-plane with one another.

24. The method of claim 20, wherein the at least one first weft yarn disposed in the first shed and the at least one second weft yarn in the second shed are in-plane with one another.

* * * * *